US009771707B2

(12) United States Patent
Lin et al.

(10) Patent No.: US 9,771,707 B2
(45) Date of Patent: Sep. 26, 2017

(54) WATER OUTPUT CONTROL APPARATUS

(71) Applicant: Xiamen Runner Industrial Corporation, Xiamen (CN)

(72) Inventors: Xian-Hai Lin, Xiamen (CN); Rong-Gui Zhang, Xiamen (CN); Xi-Min Chen, Xiamen (CN)

(73) Assignee: XIAMEN RUNNER INDUSTRIAL CORPORATION, Xiamen (CN)

( * ) Notice: Subject to any disclaimer, the term of this patent is extended or adjusted under 35 U.S.C. 154(b) by 14 days.

(21) Appl. No.: 14/950,290

(22) Filed: Nov. 24, 2015

(65) Prior Publication Data

US 2016/0146358 A1 May 26, 2016

(30) Foreign Application Priority Data

Nov. 25, 2014 (CN) ..... 2014 1 0684394

(51) Int. Cl.
*F16K 11/078* (2006.01)
*F16K 11/074* (2006.01)
*E03C 1/04* (2006.01)

(52) U.S. Cl.
CPC ..... *E03C 1/04* (2013.01); *E03C 1/0405* (2013.01); *E03C 2201/40* (2013.01)

(58) Field of Classification Search
CPC ..... Y10T 137/86549; Y10T 137/86558; Y10T 137/86831; E03C 1/0401; E03C 1/05; F16K 11/0743; F16K 19/006
See application file for complete search history.

(56) References Cited

U.S. PATENT DOCUMENTS 5,205,313 A * 4/1993 Moretti ..... F16K 35/14 137/112
5,417,348 A * 5/1995 Perrin ..... B67D 1/0059 137/606
6,029,699 A * 2/2000 Granot ..... E03C 1/04 137/565.12
6,457,191 B2 * 10/2002 Brandebusemeyer .... E03C 1/04 137/597
6,517,720 B1 * 2/2003 Aldred ..... B01D 35/04 137/545
6,634,380 B2 * 10/2003 Bartkus ..... F16K 11/0743 137/625.46
6,926,035 B2 * 8/2005 Ozagir ..... E03C 1/04 137/801

(Continued)

*Primary Examiner* — Seth W MacKay-Smith
(74) *Attorney, Agent, or Firm* — Chun-Ming Shih

(57) ABSTRACT

A water output control method and a water output apparatus for implementing the same. The method includes the following steps: connecting and pouring purified water, hot water, and room temperature water respectively into three water input ports of a control valve core; obtaining the purified water and mixed water output respectively from two separate water output ports of the control valve core, connection and communication of the water input port and the water output port is realized through the control valve core; and connecting the two water output ports of the control valve core respectively to two water input ports of a water output device, such that the two separate water output ports of the water output device output the purified water, and the mixed water respectively. The water output apparatus is simple in structure, novel in design, and easy to control.

10 Claims, 12 Drawing Sheets

(56) References Cited

U.S. PATENT DOCUMENTS

| | | | | |
|---|---|---|---|---|
| 6,959,731 | B2 * | 11/2005 | Bartkus | F16K 11/0743<br>137/625.46 |
| 7,314,189 | B2 * | 1/2008 | Nobili | F16L 39/005<br>239/549 |
| 7,607,588 | B2 * | 10/2009 | Nobili | B05B 1/1618<br>137/613 |
| 2007/0246550 | A1 * | 10/2007 | Rodenbeck | E03C 1/057<br>236/12.11 |

* cited by examiner

WATER OUTPUT CONTROL APPARATUS

BACKGROUND OF THE INVENTION

Field of the Invention

The present invention relates to a water output method and apparatus, and in particular to a water output control method and water output apparatus for implementing the same.

The Prior Arts

Due to the deteriorating quality of water supply caused by environment pollution, people are paying special attention to improve the quality of drinking water to protect their health. To achieve this purpose, water purifiers are installed in offices and households to filter and purify water. Presently, the water output apparatuses for faucet water (including room temperature water and hot water heated by a heater), and for purified water must be installed separately. As such, its installation cost is high, while its application and operation is rather inconvenient.

Therefore, presently, the design and performance of water output device and method are not quite satisfactory, and they leave much room for improvement.

SUMMARY OF THE INVENTION

In view of the problems and drawbacks of the prior art, the present invention provides a water output control method and water output apparatus for implementing the same, to overcome the shortcomings of the prior art.

The present invention provides a water output control method, comprising following steps: connecting and pouring purified water, hot water, and room temperature respectively into three water input ports of a control valve core;

obtaining the purified water and mixed water output respectively from two separate water output ports of the control valve core, connection and communication of the water input port and the water output port is realized through open or close of the control valve core;

and connecting the two water output ports of the control valve core respectively to two water input ports of a water output device, such that the two separate water output ports of the water output device output the purified water, and the mixed water respectively.

In addition to controlling connection and communication of the water input port and the water output port, the control valve core regulates water input amount of hot water and room temperature water, to realize the mixed water of various temperatures.

Two separate water output ports of the control valve core are connected respectively to two water input ports of the water output device through the respective water input tube of an inner water passage channel and an outer water passage channel.

In addition, the present invention provides a water output apparatus for implementing the water control method, comprising: a water output main body, a control valve core, and a water output device.

Wherein, the control valve core disposed in the water output main body for opening or closing water input and water output includes: a hood-shape outer shell having an upper port and a lower port, and a sway plate sleeve, a sway plate, a movable porcelain plate, and a fixed porcelain plate disposed therein. Wherein the movable porcelain plate includes a detachable upper movable plate and a detachable lower movable porcelain plate. The fixed porcelain plate includes a detachable upper fixed plate and a detachable lower fixed plate. The middle section of the sway plate is hinged and connected to the sway plate sleeve. An upward sway head of the sway plate extends out of an upper port of the hood-shape outer shell, while a downward sway head of the sway plate extends into an upper opening of the upper movable plate. In a center of a lower surface of the lower movable porcelain plate is provided with a first sinking hole, on a side of the first sinking hole is a section of arch-shape sinking hole. The lower fixed plate is provided with five through hole channels, an lower surface of the upper fixed porcelain plate is provided with five second sinking holes corresponding to the five through hole channels, while an upper surface of the upper fixed porcelain plate is provided with five holes in communication with the five second sinking holes.

The water output device connected to the water output tube of the control valve core includes: a shell, a water ejection head and a core body connected to each other in the shell. On the core body is provided with a first valve hole, a second valve hole, and a third valve hole disposed in sequence along a water flow direction from rear to front. A rear end of the core body is provided with an outer interface connected to a water input tube, while inside the outer interface is provided with an inner interface. An inner cavity of the inner interface is in communication with a first water input port at bottom of a first type cavity. An upper portion of the first type cavity is provided with first water output port, in the first type cavity is provided with a first valve plug, controlling connection and disconnection of the first water input port and the first water output port. The first water output port is connected to the first water ejection hole on a water ejection head via a channel on a side of the core body. A ring-shape water input port between the inner interface and the outer interface is connected and in communication with a second water input port on the bottom portion of the second type cavity via a channel on the other side of the core body. The second water output port on the upper portion of the second type cavity is connected and in communication with a third water input port in a central portion of a third type cavity. In the second type cavity is provided with a second valve plug, controlling connection and disconnection of the second water input port and the second water output port. The third type cavity is connected to the second water ejection hole or the third water ejection hole on and the water ejection head depending on actual requirement.

Five through hole channels of the lower fixed plate are connected respectively to a purified water input tube, a purified water output tube, a cold water input tube, a room temperature water input tube, and a mixed water output tube. Five second sinking holes on the upper fixed porcelain plate correspond to five through hole channels. The five holes on an upper surface of the upper fixed porcelain plate include a central hole and four arc-shape holes on a side of the central hole. Wherein, the central hole is in communication with a through hole channel on the lower fixed plate connecting the mixed water output tube. Two arc-shape holes of a first set are in communication with a through hole channel on the lower fixed plate connecting a water input tube and a water output tube of a water purifier. Two arc-shape holes of a second set are in communication with a through hole channel on the lower fixed plate connecting the mixed water input tube. On a lower surface of the lower fixed plate is provided with a slot for inserting a tight seal ring.

Around perimeter of a lower surface of the upper movable plate is provided with three lower protrusion plates, while on an upper surface of the lower movable porcelain plate is provided with three slots corresponding to the three lower protrusion plates. Around perimeter of upper surface of the lower fixed plate is provided with three upper protrusion plates, while around perimeter of the upper fixed porcelain plate is provided with three slots corresponding to the three upper protrusion plates.

On an upper portion of the third type cavity is provided with a third water output port X in communication with a second water ejection hole on the water ejection head, while on a lower portion of the third type cavity is provided with a third water output port Y in communication with a third water ejection hole on the water ejection head. In the third type cavity is provided with a third valve plug controlling connection of the third water input port to the third water output port X, or third water output port Y.

An interlocking connection rod is hinged and connected between the first valve plug and the second valve plug, one end of the interlocking connection rod is fastened to a lower portion of a head of the first valve plug, while the other end is fastened to the lower portion of the head of the second valve plug, to prevent open or close of the first valve plug and the second valve plug at the same time. On bottom portions of the first valve plug, the second valve plug, and the third valve plug are each provided with a spring. A first push button is provided on the shell and above the first valve plug, while a second push button is provided on the shell, and is disposed laterally above the second valve plug and the third valve plug. A central portion of a lower side of the second push button is hinged and connected onto the core body. An L-shape hook is provided at the front lower portion of the second push button, a lateral hook portion of the L-shape hook is fastened into the lower portion of the head of the third valve plug.

The water input tube includes a parent tube and a child tube sleeved in the parent tube, an inner cavity of the child tube is formed into a first channel for transporting the purified water, and between the parent tube and the child tube is formed into a second channel for transporting the mixed water. A connection sleeve is sleeved around the outer perimeter of an end portion of the parent tube, and a valve core is provided in the connection sleeve at a front end of the parent tube. In a central portion of the valve core is provided with a hole, such that the child tube passes through the hole of the valve core to form tight seal in cooperation. The perimeter of the valve core is provided with a water output port in communication with the second channel.

A cone-shape tight seal ring is provided at front end of the valve core wrapping around the child tube. An inner cavity of the connection sleeve is of a step hole structure, inner threads are provided in a big hole at a front end inside the connection sleeve. Around an end portion of the parent tube is provided with a protrusion ring, in cooperation with the hole edge of a small hole at a rear end inside the connection sleeve. A ring-shape position restricting plate is bent radially outward and is disposed at front end of the parent tube, and a second tight seal ring is provided around the valve core and is at front side of the position restricting plate.

In the water output process of the water output apparatus, purified water, hot water, and room temperature water are poured in and led into the control valve core through three separate tubes. When the control valve core is switched to open, the mixed water and purified water are flowed out through two water output tubes connected to the control valve core. Then, the water flows through a T-pipe to one end of the water input tube. Subsequently, the water flows into the water output device from the other end of the water input tube. Finally, output of purified water is realized through pressing the first push button, while output of mixed water is realized through pressing the second push button.

Compared with the existing technology, the water output apparatus of the present invention has the following advantages: compact in structure, novel in design, and easy to control, in realizing output water switching for two different water routes.

Further scope of the applicability of the present invention will become apparent from the detailed descriptions given hereinafter. However, it should be understood that the detailed descriptions and specific examples, while indicating preferred embodiments of the present invention, are given by way of illustration only, since various changes and modifications within the spirit and scope of the present invention will become apparent to those skilled in the art from this detailed descriptions.

BRIEF DESCRIPTION OF THE DRAWINGS

The related drawings in connection with the detailed descriptions of the present invention to be made later are described briefly as follows, in which.

DETAILED DESCRIPTION OF THE PREFERRED EMBODIMENT

The purpose, construction, features, functions and advantages of the present invention can be appreciated and understood more thoroughly through the following detailed description with reference to the attached drawings.

Figure 1:
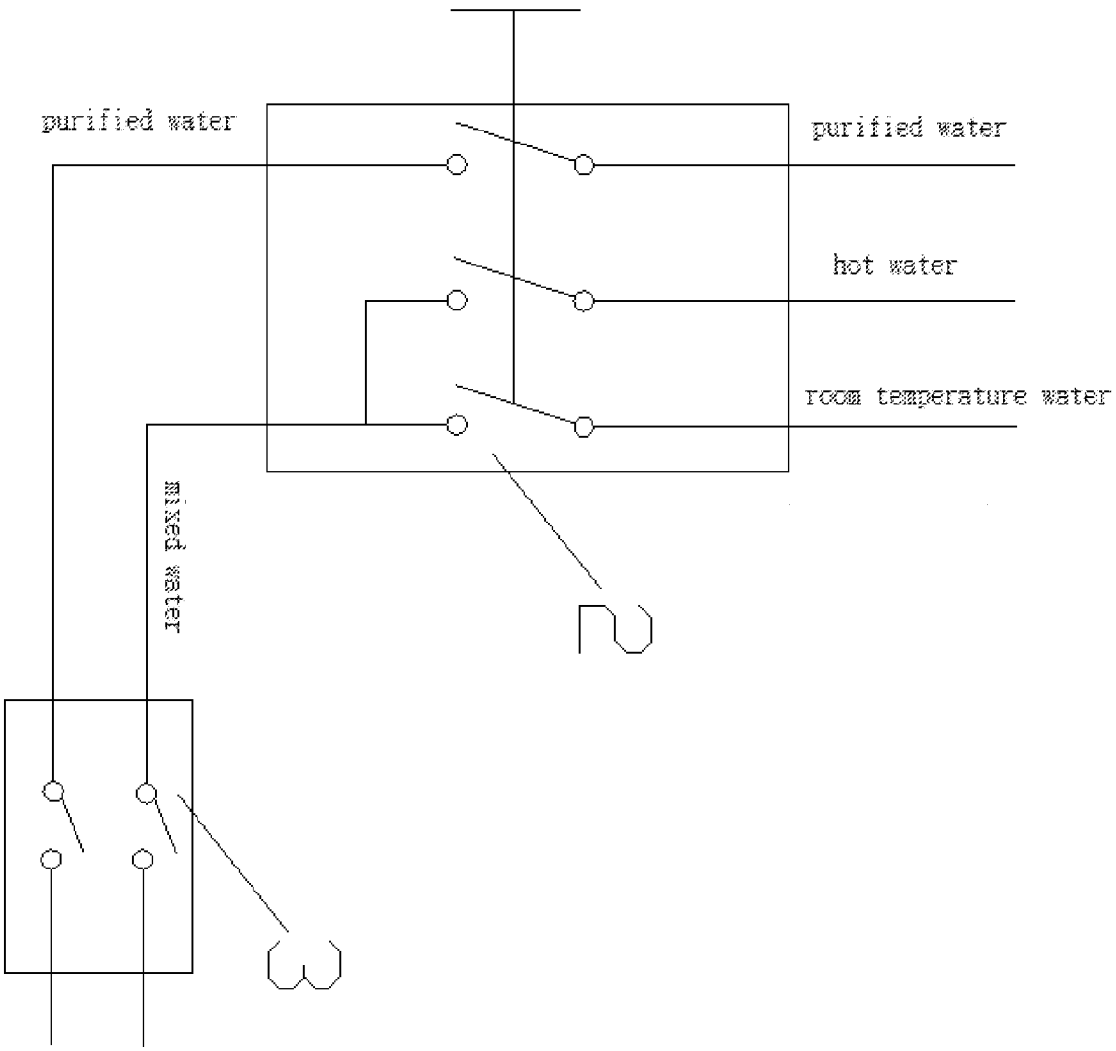
FIG. 1 is a schematic diagram of a water output design for a water output apparatus according to the present invention.
Figure 2:
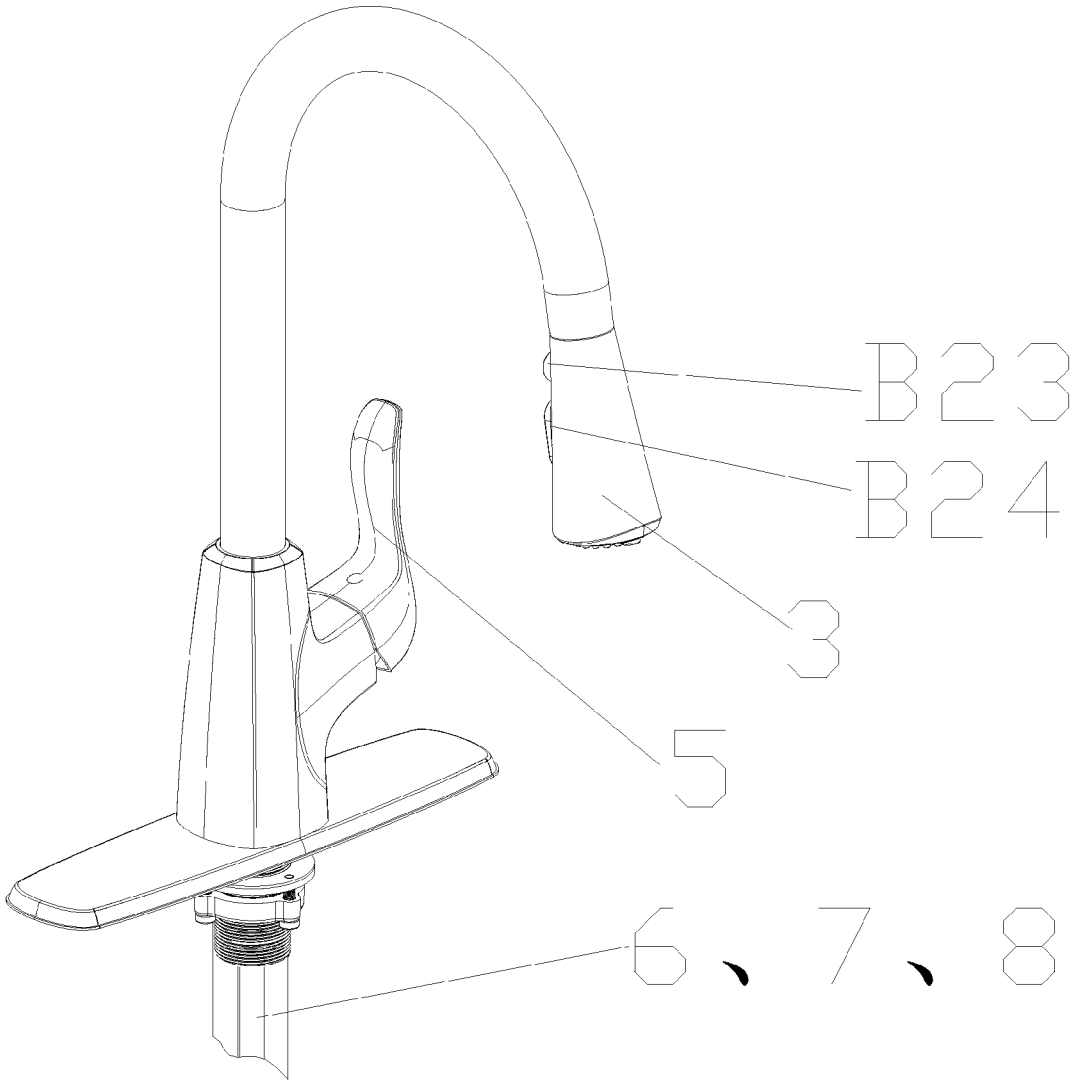
FIG. 2 is a schematic diagram of configuration of a water output apparatus according to the present invention.
Figure 3:
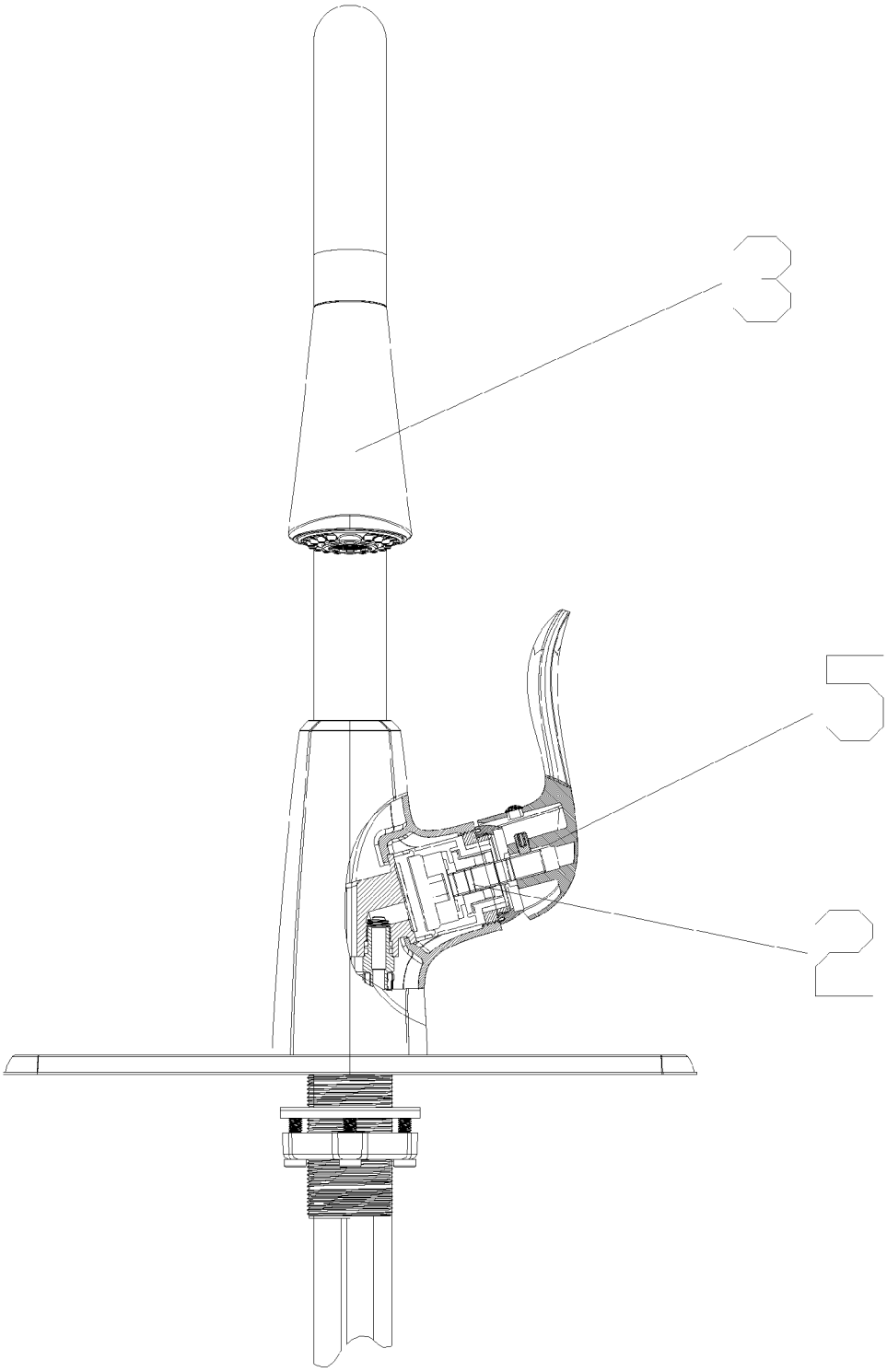
FIG. 3 is a cross section view of a water output apparatus according to the present invention.
Figure 4:
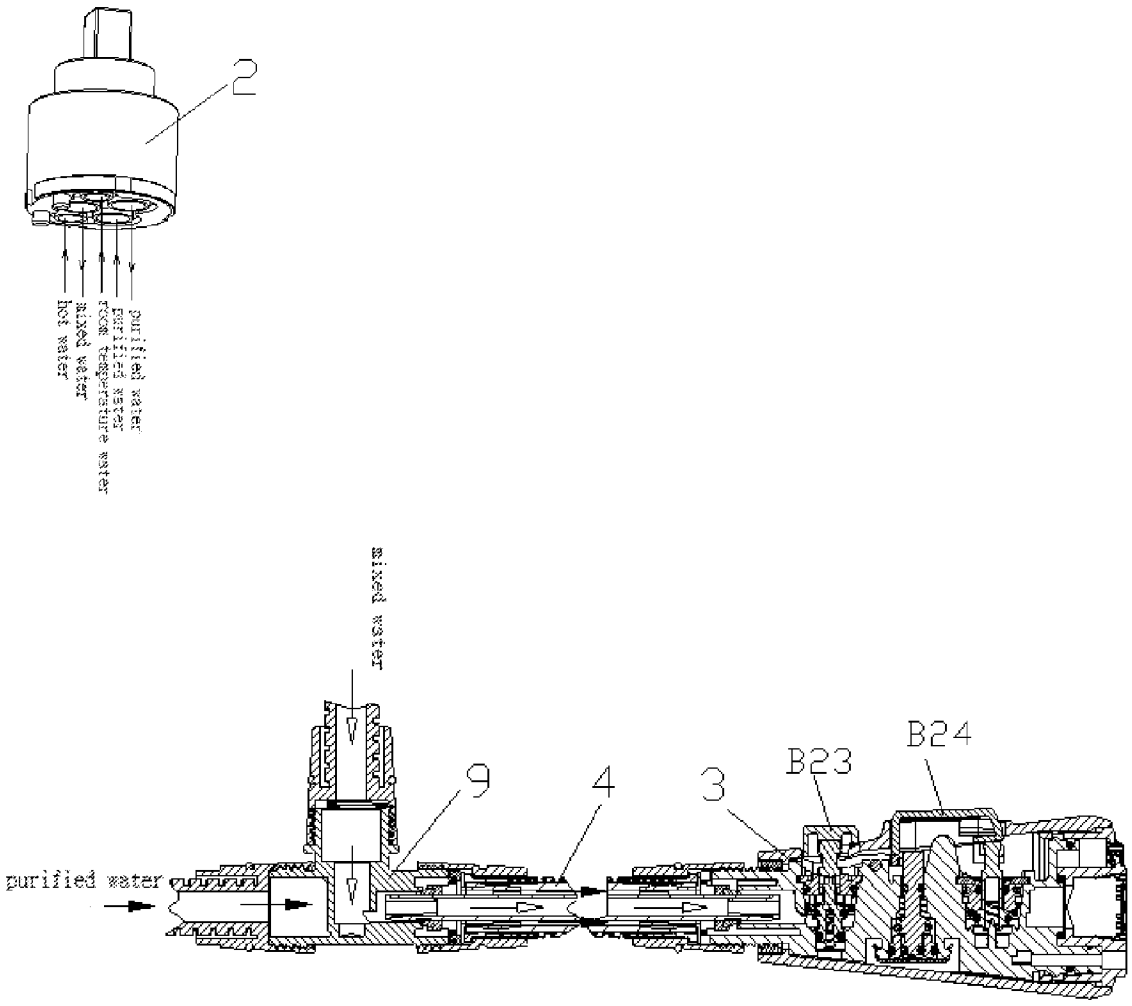
FIG. 4 is a perspective view of a water output apparatus according to the present invention.
Figure 5:
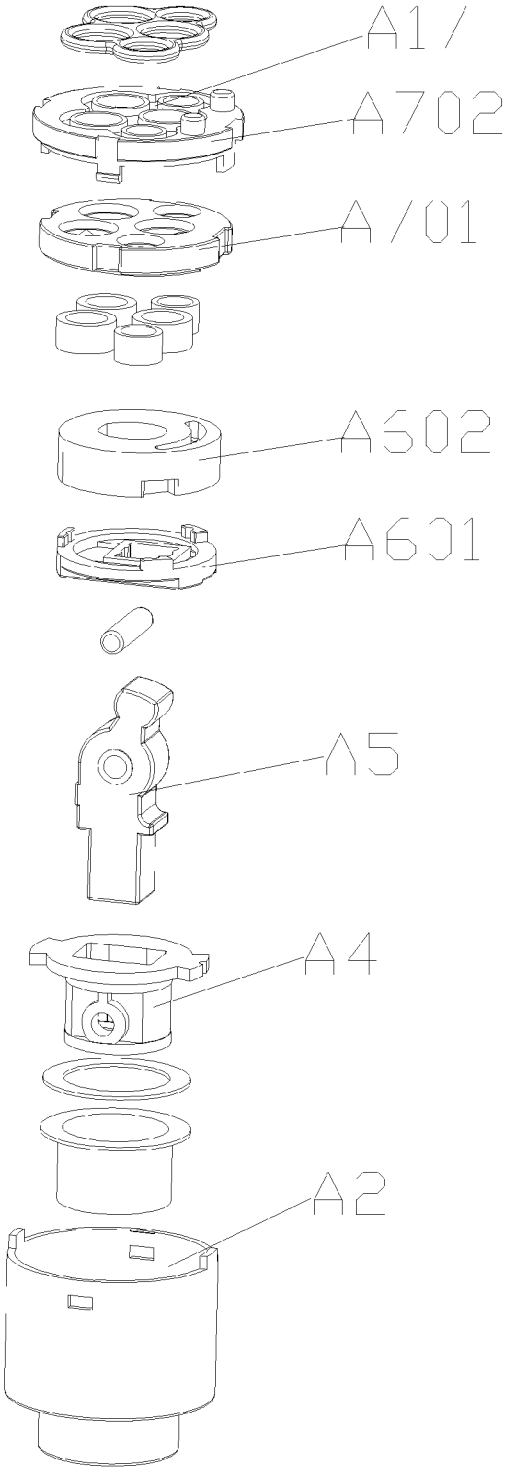
FIG. 5 is an exploded view of a control valve core according to the present invention.
Figure 6:
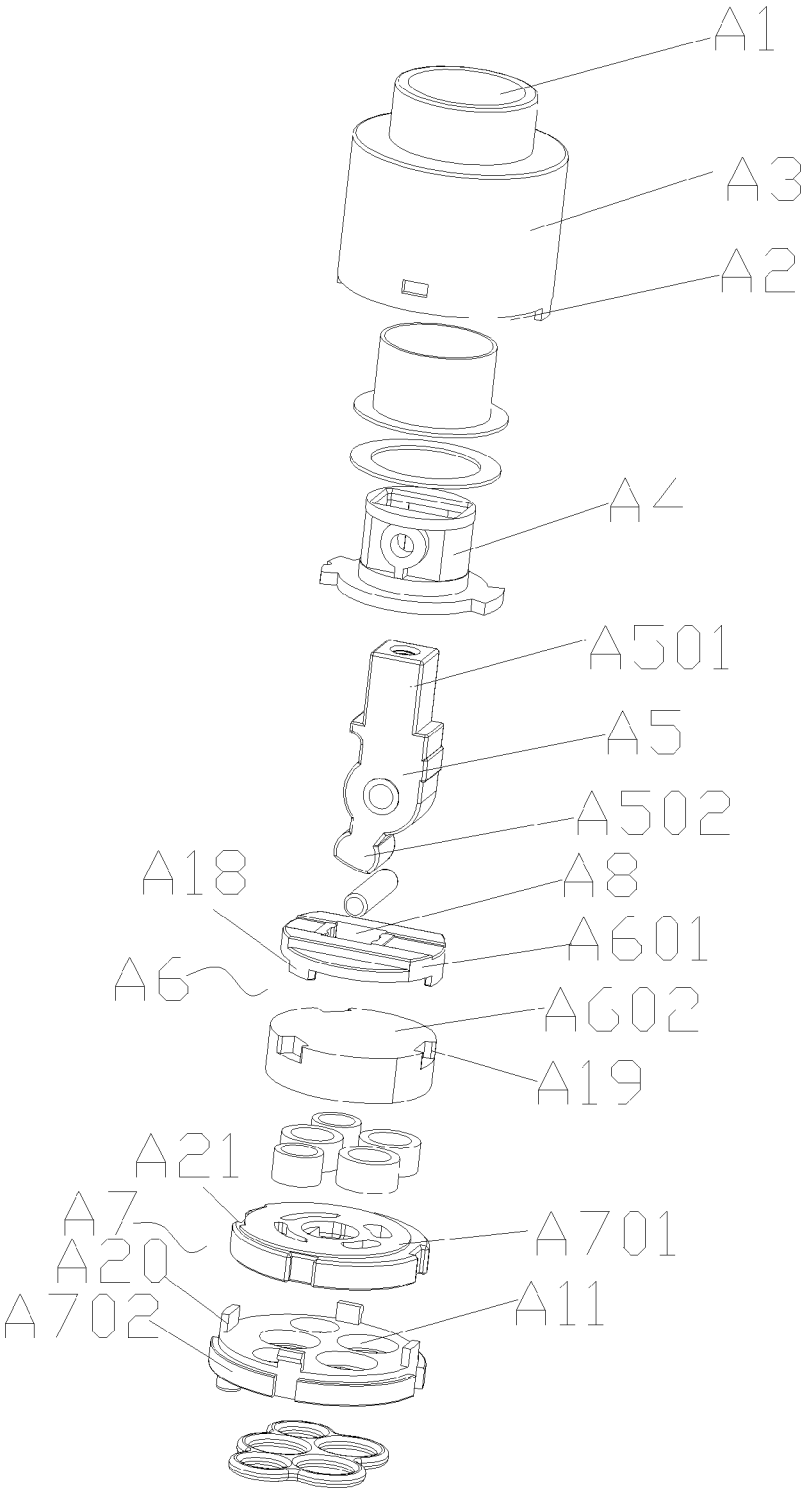
FIG. 6 is an exploded view of a control valve core according to the present invention as viewed from another angle.
Figure 7:
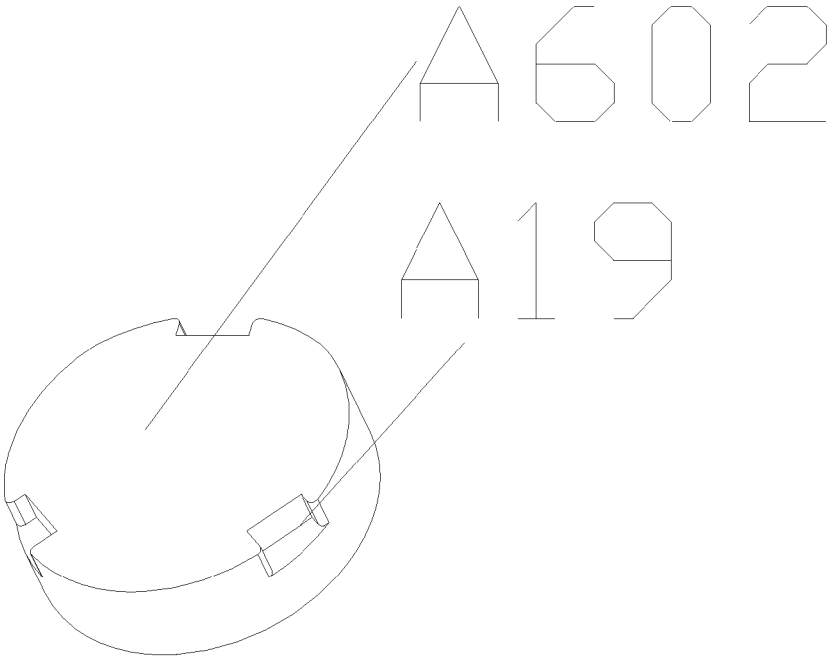
FIG. 7 is a perspective view of a lower movable porcelain plate according to the present invention.
Figure 8:
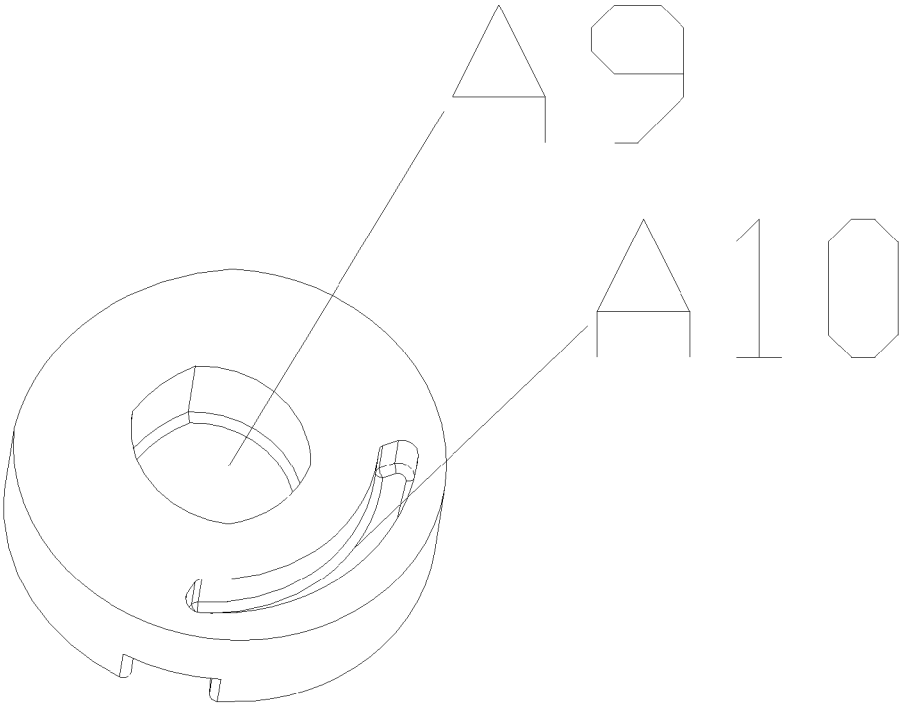
FIG. 8 is a perspective view of a lower movable porcelain plate according to the present invention as viewed from another angle.
Figure 9:
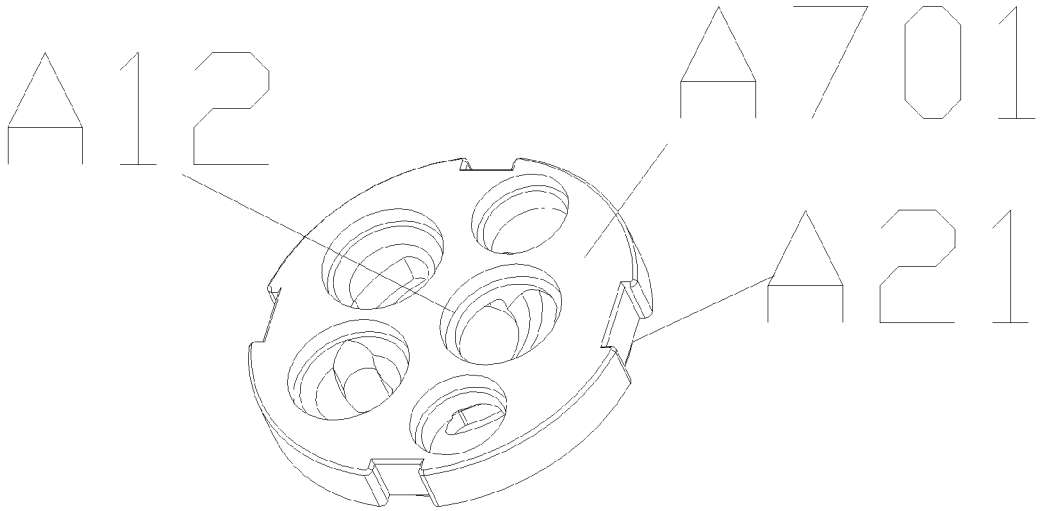
FIG. 9 is a perspective view of an upper fixed porcelain plate according to the present invention as viewed from an angle.
Figure 10:
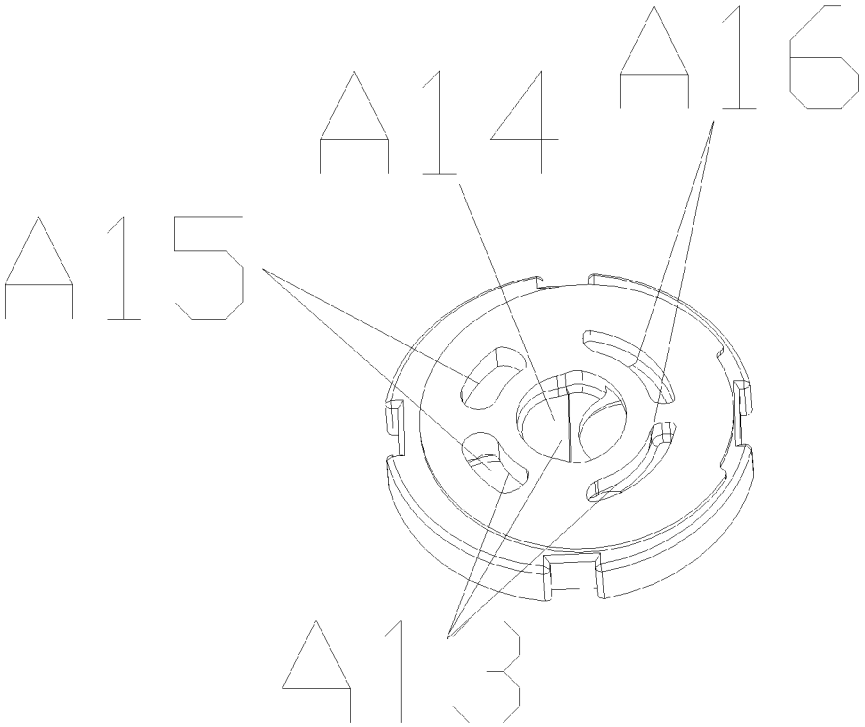
FIG. 10 is a perspective view of an upper fixed porcelain plate according to the present invention as viewed from another angle.

Refer to FIG. 1 for a schematic diagram of a water output design for a water output apparatus according to the present invention.

In order to achieve water output control, the present invention provides a water output control method, comprising following steps: pouring and leading purified water, hot water, and room temperature water respectively into three water input ports of a control valve core; obtaining the purified water and mixed water output respectively from two separate water output ports of the control valve core, connection and communication of the water input port and the water output port are realized through the control valve core; and connecting the two water output ports of the control valve core respectively to two water input ports of a water output device, such that the two separate water output ports of the water output device output the purified water, and the mixed water respectively. In the present invention, the design of the water output device is able to eliminate the use of a plurality of sets of water control handles and water output faucets, thus achieving significant reduction of component cost, and the space occupied.

In applying the water output apparatus of the present invention, since the upward swing head of the control valve core is connected to a handle 5, such that when the handle 5 is raised or pressed, the swing of the swing plate A5 is able to effect the control valve core to open and close the connection between the water input port and the water output port. When the handle 5 is rotated, the amount of the hot water and room temperature water can be adjusted, in achieving mixed water of various temperatures.

Refer to FIGS. 2 to 17 for a detailed descriptions of a water output apparatus and its components according to the present invention. As shown in FIGS. 2 to 17, the water output apparatus includes: a water output main body 1; a control valve core 2 disposed in the water output main body 1, to open or close water input and water output; and a water output device 3, connected to a water output tube of the control valve core 2.

As shown in FIGS. 5 to 10, the control valve core 2 includes: a hood-shape outer shell A3 having an upper port A1 and a lower port A2, and a sway plate sleeve A4, a sway plate A5, a movable porcelain plate A6, and a fixed porcelain plate A7 contained therein. Wherein the movable porcelain plate A6 includes a detachable upper movable plate A601 and a lower movable porcelain plate A602, while the fixed porcelain plate A7 includes a detachable upper fixed porcelain plate A701 and a detachable lower fixed plate A702. The middle section of the sway plate A5 is hinged and connected to the sway plate sleeve A4. An upward sway head A501 of the sway plate A5 extends out of an upper port A1 of the hood-shape outer shell A3. The upward sway head A501 is connected to a handle 5; while a downward sway head A502 of the sway plate A5 extends into an upper opening A8 on the upper movable plate A601. In a center of a lower surface of the lower movable porcelain plate A602 is provided with a first sinking hole A9, on a side of the first sinking hole A9 is a section of arch-shape sinking hole A10. The lower fixed plate A702 is provided with five through hole channels A11, an lower surface of the upper fixed porcelain plate A701 is provided with five second sinking holes A11 corresponding to five through hole channels A11, while an upper surface of the upper fixed porcelain plate A701 is provided with five holes A13 in communication with the five second sinking holes A12.

The five through hole channels A11 of the lower fixed plate A702 are connected respectively to a purified water input tube, a purified water output tube, a cold water input tube, a room temperature water input tube, and a mixed water output tube. The five holes A3 on an upper surface of the upper fixed porcelain plate A701 include a central hole A14 and four arc-shape holes on a side of the central hole A14. Wherein, the central hole is in communication with a through hole channel on the lower fixed plate connecting the mixed water output tube. The two arc-shape holes A16 of a first set are in communication with a through hole channel on the lower fixed plate A702 connecting the purified water input tube and the purified water output tube, while the other two arc-shape holes A15 of a second set are in communication with a through hole channel on the lower fixed plate A702 connecting the mixed water input tube. On a lower surface of the lower fixed plate A702 is provided with a slot A11 for inserting a tight seal ring.

Around perimeter of a lower surface of the upper movable plate A601 is provided with three lower protrusion plates A18, on an upper surface of the lower movable porcelain plate A602 is provided with three slots A19 corresponding to the three lower protrusion plates A18. Around perimeter of upper surface of the lower fixed plate A702 is provided with three upper protrusion plates A20, around perimeter of the upper movable plate A601 is provided with three slots A21 corresponding to the three upper protrusion plates A20.

As shown in FIGS. 14 to 17, the water output device 3 includes a shell B1, and having a water ejection head B2 and a core body B3 disposed inside and connected to each other. On the core body B3 is provided with a first valve hole B4, a second valve hole B5, and a third valve hole B6 disposed in sequence along a water flow direction from rear to front. A rear end of the core body B3 is provided with an outer interface B7 connected to a water input tube 4, while inside the outer interface B7 is provided with an inner interface B8. An inner cavity of the inner interface B8 is in communication with a first water input port B9 at bottom of a first type cavity B4. On an upper portion of the first type cavity B4 is provided with first water output port B10. In the first type cavity B4 is provided with a first valve plug B11 controlling connection and disconnection of the first water input port B9 and the first water output port B10. The first water output port B10 is connected to the first water ejection hole B12 on a water ejection head B2 via a channel on a side of the core body B3. The first flow body enters the first valve hole B4 through the inner cavity of the inner interface B8, then it is ejected from the first ejection hole of the water ejection head B2. In this case, the first flow body can be the purified water obtained through filtering.

A ring-shape water input port B26 between the inner interface B8 and the outer interface B7 is connected and in communication with a second water input port B13 on the bottom portion of the second valve hole B5 via a channel on the other side of the core body B3. The second water output port B14 on the upper portion of the second valve hole B5 is connected and in communication with a third water input port B15 in a central portion of a third valve hole B6. In the second valve hole B5 is provided with a second valve plug B16, controlling connection and disconnection of the second water input port B13 and the second water output port B14. The third valve hole B6 is connected to the second water ejection hole B17 or the third water ejection hole B18 on and water ejection head B2. Wherein, the second water ejection hole B17 is used for shower water ejection, while the third water ejection hole B18 is used for concentrated water ejection. The second flow body (mixed water) flows into the second valve hole B5 via the ring-shape water input port B26 between the outer interface B7 and the inner interface B8, then it is ejected out of the first water ejection hole B17 or the second water ejection hole B18 on the water ejection head B2. In this case, the second flow body can be the mixed water without going through filtering.

On an upper portion of the third type cavity B6 is provided with a third water output port X (B19) in communication with a second water ejection hole B17 on the water ejection head B2. At the lower portion of the third type cavity B6 is provided with a third water output port Y (B20), connected and in communication with the third water ejection hole B18 on the water ejection head B2. In the third type cavity B6 is provided with a third valve plug B21 controlling connection and communication of the third water input port B15 to the third water output port X (B19) or third water output port Y (B20). When the third valve plug B21 moves downward, the third water input port B15 and the third water output port X (B19) is connected and in communication. When the third valve plug B21 moves upward, the third water input port B15 and the third water output port Y (B20) are connected and in communication. Therefore, water output of the second flow body is switched by the upward or downward movements of the third valve plug B21.

An interlocking connection rod B22 is hinged and connected between the first valve plug B11 and the second valve plug B16. One end of the interlocking connection rod is fastened to a lower portion of a head of the first valve plug B11, while other end is fastened to the lower portion of the head of the second valve plug B16, to prevent open or close of the first valve plug B11 and the second valve plug B12 at the same time.

When the first valve plug B11 moves downward, the first type cavity B4 is opened, so that the first water input port B9 and the first water output port B10 are connected and in communication. At the same time, the second valve plug B16 moves upward, to close the second type cavity. When the second valve plug B16 moves downward, the second valve hole B5 is opened, so that the second water input port B13 and the second water output port B14 are connected and in communication. At the same time, the first valve plug B11 moves upward, to close the first valve hole B4.

Therefore, only one of the first flow body (purified water) and the second flow body (mixed water) is ejected from the ejection head B2, and the third valve plug B21 is used to switch water output of the second flow body (mixed water).

On the bottom portions of the first valve plug B11, the second valve plug B16, and the third valve plug B21 are each provided with a restoring spring. When the first valve plug B11 or the second valve plug B16 move downward, the pressure of water may keep it in a downward moving condition. A first push button B23 is provided on the shell B1 and is located above the first valve plug B11; while a second push button B24 is provided on the shell B1, and is disposed laterally above the second valve plug B16 and the third valve plug B21. A central portion on a lower side of the second push button B24 is hinged and connected onto the core body B3. An L-shape hook B25 is provided at the front lower portion of the second push button B24. A lateral hook portion of the L-shape hook B25 is fastened into the lower portion of the head of the third valve plug B21. When the rear end of the second push button B24 is pushed downward, the second valve plug B16 is moved downward, at the same time the third valve plug B21 is moved upward. In case it is desired to switch water output, then press the front end of the second push button B24 downward, such that the third valve plug B21 is moved downward. The second valve plug B16 is kept in the condition of moving downward by the water pressure, to keep the second valve hole B5 open.

Figure 11:
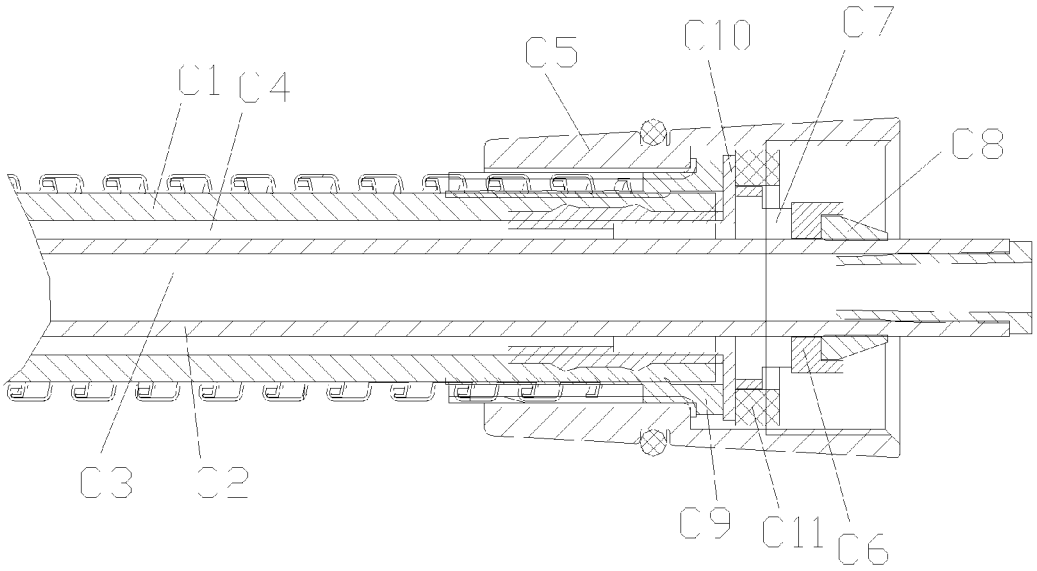
FIG. 11 is a schematic diagram of a water input tube according to the present invention.
Figure 12:
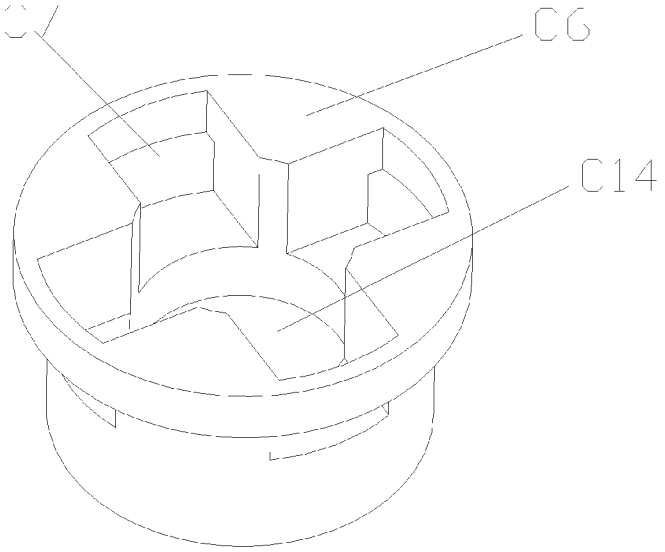
FIG. 12 is a perspective view of a water input tube valve core according to the present invention.

Further, as shown in FIGS. 11 and 12, the water input tube 4 connecting to the water input end of the water output device includes a parent tube C1 and a child tube C2 sleeved in the parent tube C1. An inner cavity of the child tube C2 is formed into a first channel C3 for transporting the purified water; while between the parent tube C1 and the child tube C2 is provided with and is formed into a second channel C4 for transporting the mixed water. A connection sleeve C5 is sleeved around the outer perimeter of an end portion of the parent tube C1, and a valve core C6 is provided in the connection sleeve C5 at a front end of the parent tube C1. In a central portion of the valve core C6 is provided with a central hole C14, such that the child tube C2 passes through the central hole C14 of the valve core C6 to form tight seal in cooperation. The perimeter of the valve core C6 is provided with a water output port C7 in communication with the second channel C4. The water output end of the water input tube 4 is connected to the water input port of the water output device 3. The water input port of the water output device 3 includes the outer interface B7 having outer threads, and the inner interface B8 disposed in the outer interface B7. An inner cavity of the inner interface B8 is in communication with a purified water route in the water output device 3. The ring-shape water input port B26 between the inner interface B8 and the outer interface B7, is in communication with the mixed water route in the water output device 3.

A cone-shape tight seal ring C8 is provided at front end of the valve core C6 wrapping around the child tube C2. The minor end of the cone-shape tight seal ring C8 faces forward. An inner cavity of the connection sleeve C5 is of a step hole structure. Inner threads are provided in a big hole at a front end inside the connection sleeve C5. Around an end of the parent tube C1 is provided with a protrusion ring C9, in cooperation with the hole edge of a small hole at a rear end inside the connection sleeve C5. A ring-shape position restricting plate C10 is bent radially outward and is disposed at front end of the parent tube C1, and a second tight seal ring C11 is provided around the valve core C6 at front side of the position restricting plate C10. When the connection sleeve C5 and the outer interface B7 are connected through rotations, the protrusion ring C9 pushes the parent tube C1 to connect the outer interface B7, the child tube C2 to connect the inner interface B8, the end portion of the outer interface B7 pressing tightly the second seal ring C11, so that the outer interface B7 and the parent tube C1 are connected into tight seal; and the end portion of the inner interface B8 pressing tightly the cone-shape tight seal ring C8, so that the inner interface B8 and the child tube C2 are connected into tight seal.

On the main body is provided with a handle 5, a room temperature water input tube 6, a hot water input tube 7, a purified water input tube 8, and they are connected to the three through hole channels A11 located on the control valve core 2 of the main body, through the bottom portion of the main body. Then, they are connected from the two through hole channels A11 on the control valve core 2 to the two water input ports of the T-pipe 9 through a connection pipe line. The third end of the T-pipe 9 is connected to the water input end of the water input tube 4. The water output end of the water input tube 4 is connected to the water output device 3. As such, output of purified water can be realized through pressing the first push button B23, while output of mixed water can be realized through pressing the second push button B24.

Figure 13:
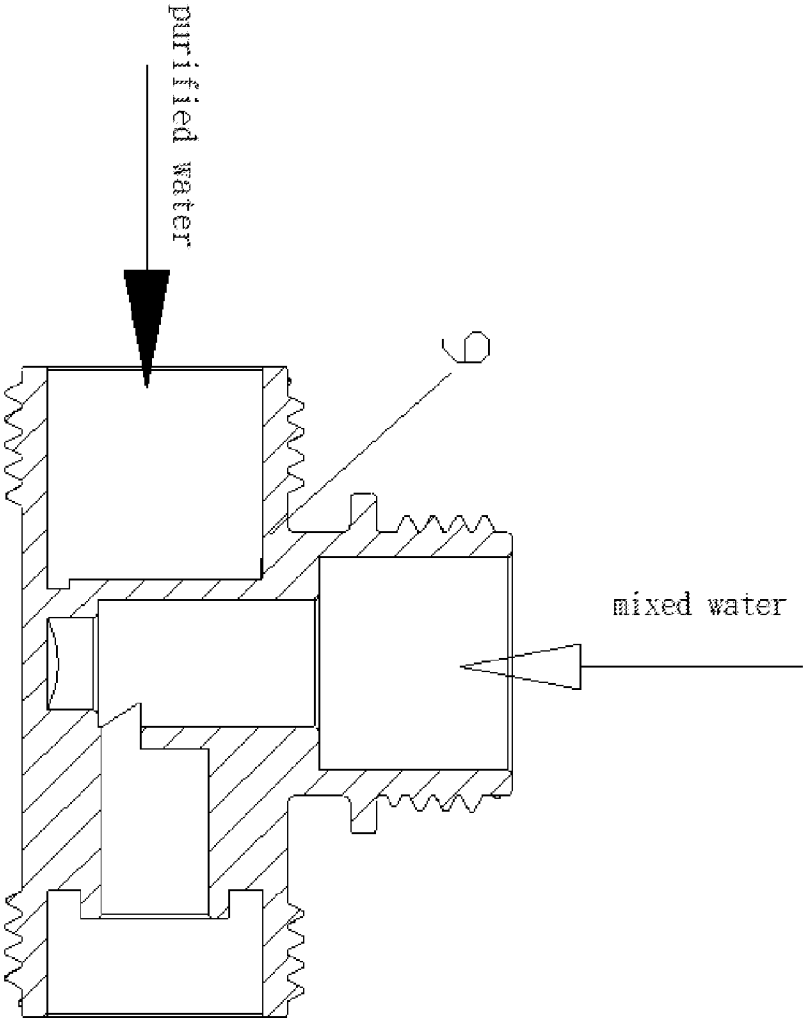
FIG. 13 is a schematic diagram of a T-pipe according to the present invention.
Figure 14:
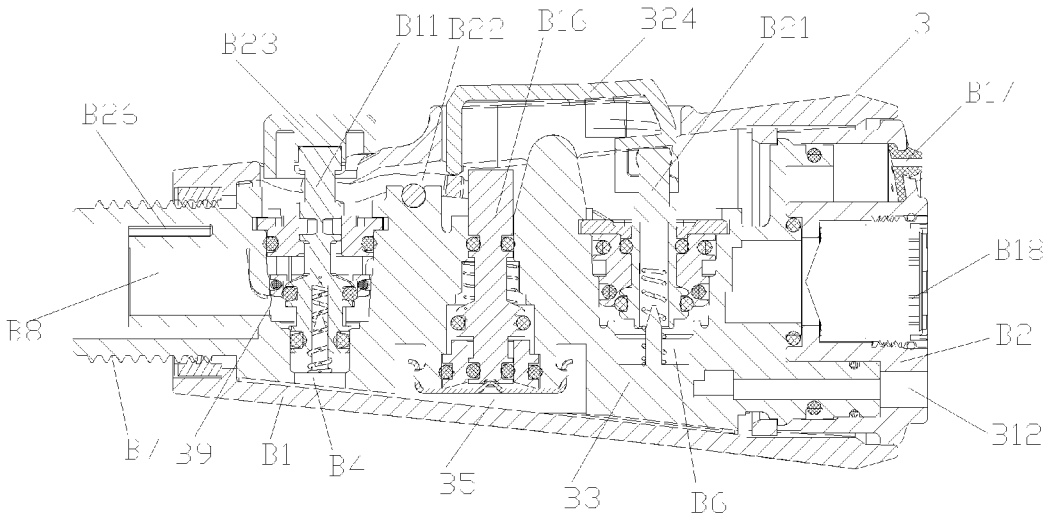
FIG. 14 is a cross section view of a water output device in a first water output state according to the present invention.
Figure 15:
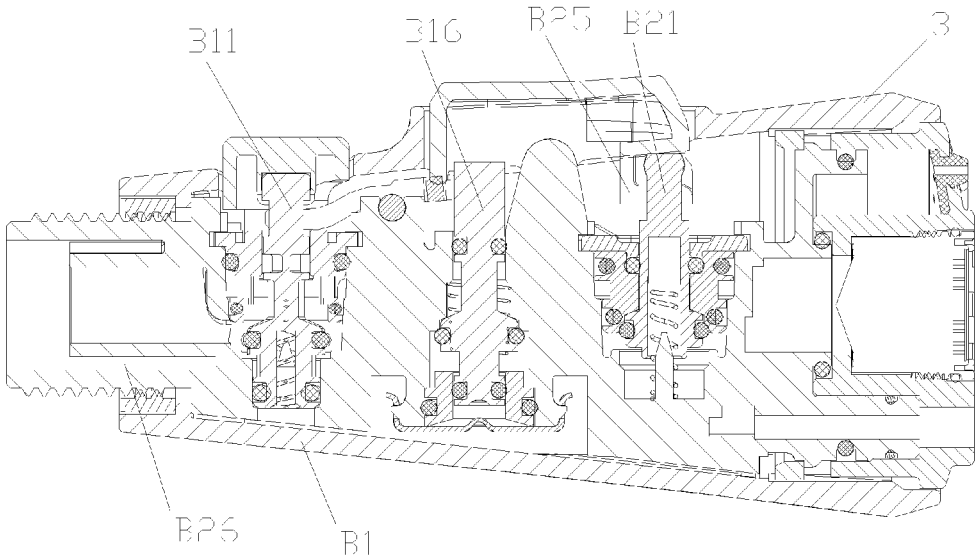
FIG. 15 is a cross section view of a water output device in a second water output state according to the present invention.
Figure 16:
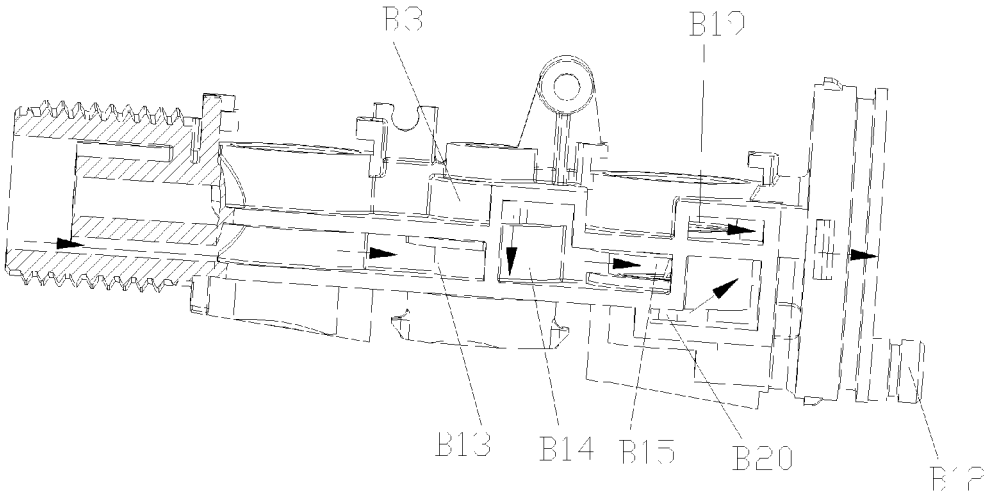
FIG. 16 is a front perspective view of a core body of a water output device according to the present invention.
Figure 17:
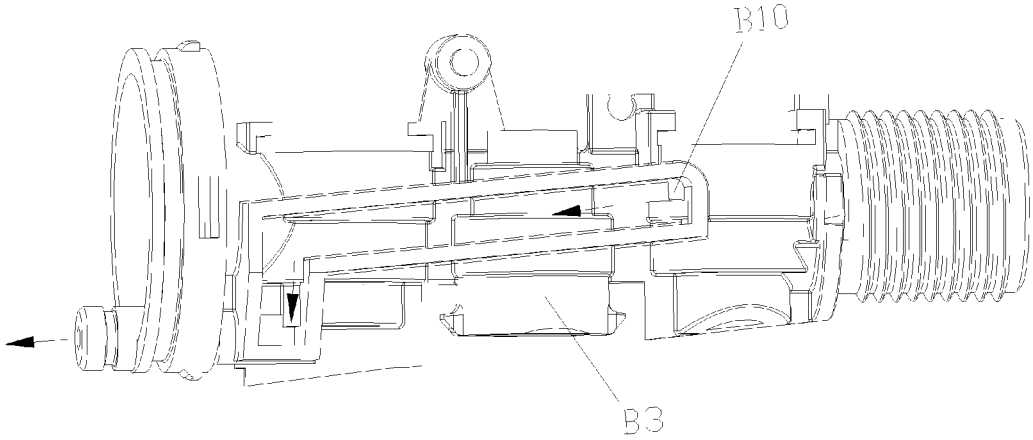
FIG. 17 is a rear perspective view of a core body of a water output device according to the present invention.

The T-pipe 9 is provided with two water input ports (one for purified water, the other one for mixed water), and a water output port. Wherein, the water output port is provided with two separate water output ports. One of the water output ports is connected to water input port, while the other water output port is connected to the other water input port (FIG. 13). The purified water can be acid water, or mineral water. But, the present invention is not limited to this.

Compared with the existing technology, the water output apparatus of the present invention has the following advantages: compact in structure, novel in design, and easy to control, hereby realizing output water switching for two different water routes.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. A water output control apparatus, comprising:

a water output main body, a control valve core disposed in the water output main body to open or close water input and water output, including:

a hood-shape outer shell having an upper port and a lower port; a sway plate sleeve, a sway plate, a movable porcelain plate, and a fixed porcelain plate, wherein the movable porcelain plate includes a detachable upper movable plate and a detachable lower movable porcelain plate, the fixed porcelain plate includes a detachable upper fixed porcelain plate and a detachable lower fixed plate, wherein a middle section of the sway plate is connected via a hinge connected to the sway plate sleeve, an upward sway head of the sway plate extends out of an upper port of the hood-shape outer shell, while a downward sway head of the sway plate extends into an upper opening of the upper movable plate, in a center of a lower surface of the lower movable porcelain plate is provided with a first sinking hole, on a side of the first sinking hole is a section of arch-shape sinking hole, the lower fixed plate is provided with five through hole channels, a lower surface of the upper fixed porcelain plate is provided with five second sinking holes corresponding to the five through hole channels, while an upper surface of the upper fixed porcelain plate is provided with five holes in communication with the five second sinking holes; and wherein the water output device is connected to the water output tube of the control valve core, including:

a shell, a water ejection head, disposed in the shell;

a core body, disposed in the shell, and connected to the water ejection head, wherein on the core body is provided with a first valve hole, a second valve hole, and a third valve hole disposed in sequence along a water flow direction from rear to front, a rear end of the core body is provided with an outer interface connected to a water input tube, while inside the outer interface is provided with an inner interface, an inner cavity of the inner interface is in communication with a first water input port at a bottom of a first type cavity, an upper portion of the first type cavity is provided with a first water output port, in the first type cavity is provided with a first valve plug, controlling connection and disconnection of the first water input port and the first water output port, the first water output port is connected to the first water ejection hole on the water ejection head via a first channel on a side of the core body, a ring-shape water input port between the inner interface and the outer interface is connected and in communication with a second water input port on the bottom portion of the second type cavity via a second channel on the other side of the core body, a second water output port on the upper portion of the second type cavity is connected and in communication with a third water input port in a central portion of a third type cavity, in the second type cavity is provided with a second valve plug, controlling connection and disconnection of the second water input port and the second water output port, the third type cavity is connected and in communication with a second water ejection hole or a third water ejection hole on the water ejection head, and the third type cavity is connected and in communication with the second water ejection hole or the third water ejection hole on the water ejection head.

2. The water output control apparatus as claimed in claim 1, wherein the five through hole channels of the lower fixed plate are connected respectively to a purified water input tube, a purified water output tube, a cold water input tube, a room temperature water input tube, and a mixed water output tube, the five second sinking holes on the upper fixed porcelain plate correspond to the five through hole channels, the five holes on the upper surface of the upper fixed porcelain plate include a central hole and four arc-shape holes on a side of the central hole, wherein the central hole is in communication with a first through hole channel on the lower fixed plate connecting a mixed water output tube, two arc-shape holes of a first set are in communication with a second through hole channel on the lower fixed plate connecting the purified water input tube and a purified water output tube, two arc-shape holes of a second set are in communication with a third through hole channel on the lower fixed plate connecting the mixed water input tube, and a lower surface of the lower fixed plate is provided with a slot for inserting a tight seal ring.

3. The water output control apparatus as claimed in claim 2, wherein around perimeter of a lower surface of the upper movable plate is provided with three lower protrusion plates, an upper surface of the lower movable porcelain plate is provided with three slots corresponding to the three lower protrusion plates, a perimeter of upper surface of the lower fixed plate is provided with three upper protrusion plates, and a perimeter of the upper movable porcelain plate is provided with three slots corresponding to the three upper protrusion plates.

4. The water output control apparatus as claimed in claim 1, wherein an upper portion of the third type cavity is provided with a third water output port X in communication with the second water ejection hole on the water ejection head, a lower portion of the third type cavity is provided with a third water output port Y in communication with the third water ejection hole on the water ejection head, and the third type cavity is provided with a third valve plug controlling connection of the third water input port to the third water output port X, or the third water output port Y.

5. The water output control apparatus as claimed in claim 4, wherein an interlocking connection rod is hinged and connected between the first valve plug and the second valve plug, one end of the interlocking connection rod is fastened to a lower portion of a head of the first valve plug, while other end is fastened to the lower portion of the head portion of the second valve plug, to prevent open or close of the first valve plug and the second valve plug at the same time, on bottom portions of the first valve plug, the second valve plug, and the third valve plug are each provided with a spring, a first push button is provided on the shell above the first valve plug, while a second push button is provided on the shell, and is disposed laterally above the second valve plug and the third valve plug, a central portion of a lower side of the second push button is hinged and connected onto the core body, an L-shape hook is provided at the front lower portion of the second push button, and a lateral hook portion of the L-shape hook is fastened into the lower portion of the head of the third valve plug.

6. The water output control apparatus as claimed in claim 1, wherein the water input tube includes a parent tube and a child tube sleeved in the parent tube, an inner cavity of the child tube is formed into a first channel for transporting the purified water, and between the parent tube and the child tube is provided with and is formed into a second channel for transporting the mixed water, a connection sleeve is sleeved around the outer perimeter of an end portion of the parent tube, and a valve core is provided in the connection sleeve at a front end of the parent tube, a central portion of the valve core is provided with a hole, such that the child tube passes through the hole of the valve core to form a tight seal, and the perimeter of the valve core is provided with a water output port in communication with the second channel.

7. The water output control apparatus as claimed in claim 6, wherein a cone-shape tight seal ring is provided at front end of the valve core wrapping around the child tube, an inner cavity of the connection sleeve is of a step hole structure, inner threads are provided in a big hole at a front end inside the connection sleeve, an end of the parent tube is provided with an annular protrusion ring, in cooperation with the hole edge of a small hole at a rear end inside the connection sleeve, a ring-shape position restricting plate is bent radially outward and is disposed at a front end of the parent tube, and a second tight seal ring is provided around the valve core at a front side of the position restricting plate.

8. The water output control apparatus as claimed in claim 1, wherein the water output control apparatus is used for implementing a water control method, the water output control method comprising following steps:

connecting and conveying purified water, hot water, and room temperature water respectively into three water input ports of a control valve core;

obtaining the purified water and mixed water output respectively from two separate water output ports of the control valve core, wherein connection and communication of the water input ports and the water output ports is realized through the control valve core; and connecting the two separate water output ports of the control valve core respectively to two water input ports of a water output device, such that two separate water output ports output the purified water and the mixed water respectively.

9. The water output control apparatus as claimed in claim 8, wherein the control valve core regulates a water input amount of the hot water and the room temperature water to realize the mixed water of various temperatures.

10. The water output control apparatus as claimed in claim 8, wherein the two separate water output ports of the control valve core are connected respectively to the two water input ports of the water output device through respective water input tubes of an inner water passage channel and an outer water passage channel.

* * * * *